US009914635B2

(12) United States Patent
Guzman et al.

(10) Patent No.: US 9,914,635 B2
(45) Date of Patent: Mar. 13, 2018

(54) MANNEQUIN UPHOLSTERY SHAPING DEVICE

(71) Applicant: SEVEN CONTINENTS CORP., Toronto (CA)

(72) Inventors: Julio Javier Guzman, North York (CA); Iana Bashura, Toronto (CA)

(73) Assignee: Seven Continents Corp., Toronto, ON (CA)

( * ) Notice: Subject to any disclaimer, the term of this patent is extended or adjusted under 35 U.S.C. 154(b) by 55 days.

(21) Appl. No.: 15/094,145

(22) Filed: Apr. 8, 2016

(65) Prior Publication Data

US 2017/0291810 A1 Oct. 12, 2017

(51) Int. Cl.

| | |
|---|---|
| ***A47F 8/02*** | (2006.01) |
| ***A41H 5/01*** | (2006.01) |
| ***B68G 7/12*** | (2006.01) |

(52) U.S. Cl.

CPC ..... *B68G 7/12* (2013.01); *A41H 5/01* (2013.01); *A47F 8/02* (2013.01)

(58) Field of Classification Search

CPC ... A41H 5/00; A41H 5/01; A41H 5/02; D06C 5/00; A63H 3/02; A63H 3/04; B68G 7/12; A47F 8/00; A47F 8/02

USPC ..... D20/29–32

See application file for complete search history.

(56) References Cited

U.S. PATENT DOCUMENTS

| | | | | | |
|---|---|---|---|---|---|
| 1,376,502 | A * | 5/1921 | Bailey | A41H 5/00 | 223/68 |
| 2,985,344 | A * | 5/1961 | Quaintance | A41H 5/02 | 223/67 |
| 3,134,524 | A * | 5/1964 | Stewart | A41H 5/00 | 223/68 |
| 3,341,095 | A * | 9/1967 | Sawallesh | A41H 41/00 | 223/68 |
| 3,362,593 | A * | 1/1968 | Cram | A41H 5/00 | 223/68 |
| 5,265,779 | A * | 11/1993 | Jiang | A41H 5/01 | 223/66 |
| 2003/0226863 | A1 * | 12/2003 | Hickle | D06F 73/00 | 223/57 |

FOREIGN PATENT DOCUMENTS

DE 202013003772 U * 5/2013

* cited by examiner

*Primary Examiner* — Ismael Izaguirre

(57) ABSTRACT

The invention pertains to upholstery techniques for upholstering the central bust line of mannequins. Particularly a shaping body is coupled to the central line of the upholstery and shaped to conform to the central bust line of an underlying mannequin form. The shaping body includes anchors, preferably, in the form of strings, which can be fed through the mannequin form and tensioned accordingly. The shaping body is preferably elongate with two identical body members coupled by a fold therebetween. The first body member is coupled to a first side of the central bust line seam of the upholstering covering and the second body member is coupled to the second side of the central bust line seam of the upholstering covering. The fold therebetween is shaped to conform to the shape of the central bust line of the mannequin form. The use of such a shaping body results in a natural convex curve of the central bust line.

8 Claims, 8 Drawing Sheets

MANNEQUIN UPHOLSTERY SHAPING DEVICE

FIELD OF THE INVENTION

The invention pertains to upholstery techniques to create convex curves. More particularly, the invention pertains to upholstery techniques for upholstering the bust line of mannequins with a convex curve.

BACKGROUND OF THE INVENTION

The use of mannequins resembling the human form, or part of the human form, are common in retail locations, particularly those displaying clothes or accessories. Traditionally, these mannequins have been formed out of fiberglass, but could also be formed of plastic, plaster, wood or a combination thereof. There are some mannequins that are upholstered with fabric to create an alternative or more elegant look. When upholstering female form mannequins, it is challenging to create an upholstered bust with a realistic sunken bust line between the female breasts. Often times, upholstered mannequins omit a central bust line and treat the breasts as a solid horizontal unit. Alternatively, only subtle indents between the breasts are created. Such designs can be satisfactory for displaying certain clothing or accessories. However, in certain applications, for example displaying lingerie, a more realistic upholstered mannequin is preferred to create an appealing and realistic look.

One upholstery technique to create a sunken breast is shown in FIGS. 1 and 2, FIG. 1 shows an upholstered mannequin 2 having a central bust line 4. As shown in FIG. 2 the fabric 6 is adapted to fit over a rigid mannequin form 8. Typically the rigid mannequin form is made out of plastic, however any other suitable material could be used. In order to create a bust line, a shaping body 10 is attached to the central seam 11 which defines the central bust line 4. The shaping body of the prior art is straight in shape. The shaping body is sewn to the central bust line seam 11 and includes 3 strings or anchors 12, 14, and 16 attached thereto. These anchors are pulled through channels 20, 22, and 24 in the rigid mannequin form 8 before they are fixed to the back of the mannequin. The anchor strings 12, 14 and 16 can be adjusted in tension to create a central bust line 4 between the breasts of the mannequin.

Although this bust line is in an improvement over previous methods, the bust line is not a smooth curve and typically includes a jagged transition shown in FIG. 1 at reference 18 where the shaping body 10 is attached. Additionally, the bust line can become jagged at the middle anchor 14 as the straight shaping body does not conform to the shape of the rigid mannequin between the breasts. A more realistic bust line in upholstered mannequins is required.

SUMMARY OF THE INVENTION

The invention pertains to a shaping device for creating a central bust line on a mannequin having a base form and an upholstery cover. The shaping device includes an elongate shaping body configured to be coupled to the upholstery covering along the central bust line and at least one anchor for coupling the shaping body to the base form. The shaping body is designed such that when coupled to the base form, one edge of the shaping body generally conforms to the shape of the central bust line of the base form.

In a further aspect of the invention, the shaping body is curved to conform with the curve of the central bust line of the base form.

In a further aspect of the invention, the shaping body has a first body member and a second body member joined by a fold therebetween. The first body member is coupled to a first side of a central bust line seam of the upholstery covering and the second body member is coupled to a second side of the central bust line seam of the upholstery covering. The fold conforms to the shape of the central bust line of said base form.

In a further aspect of the invention, the curve of the central bust line of the base form is convex.

In a further aspect of the invention, the first body member and the second body member of the shaping body include a series of slits opposite said fold to allow the shaping device to curve to generally conform to the shape of the central bust line of the base form.

In a further aspect of the invention, the at least one anchor is a string coupled to said shaping device and fed through a hole in said base form and is fixed to said base form.

In a further aspect of the invention, the shaping device includes two anchors.

In a further aspect of the invention, the two anchors are positioned at opposite ends along the length of the shaping body.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
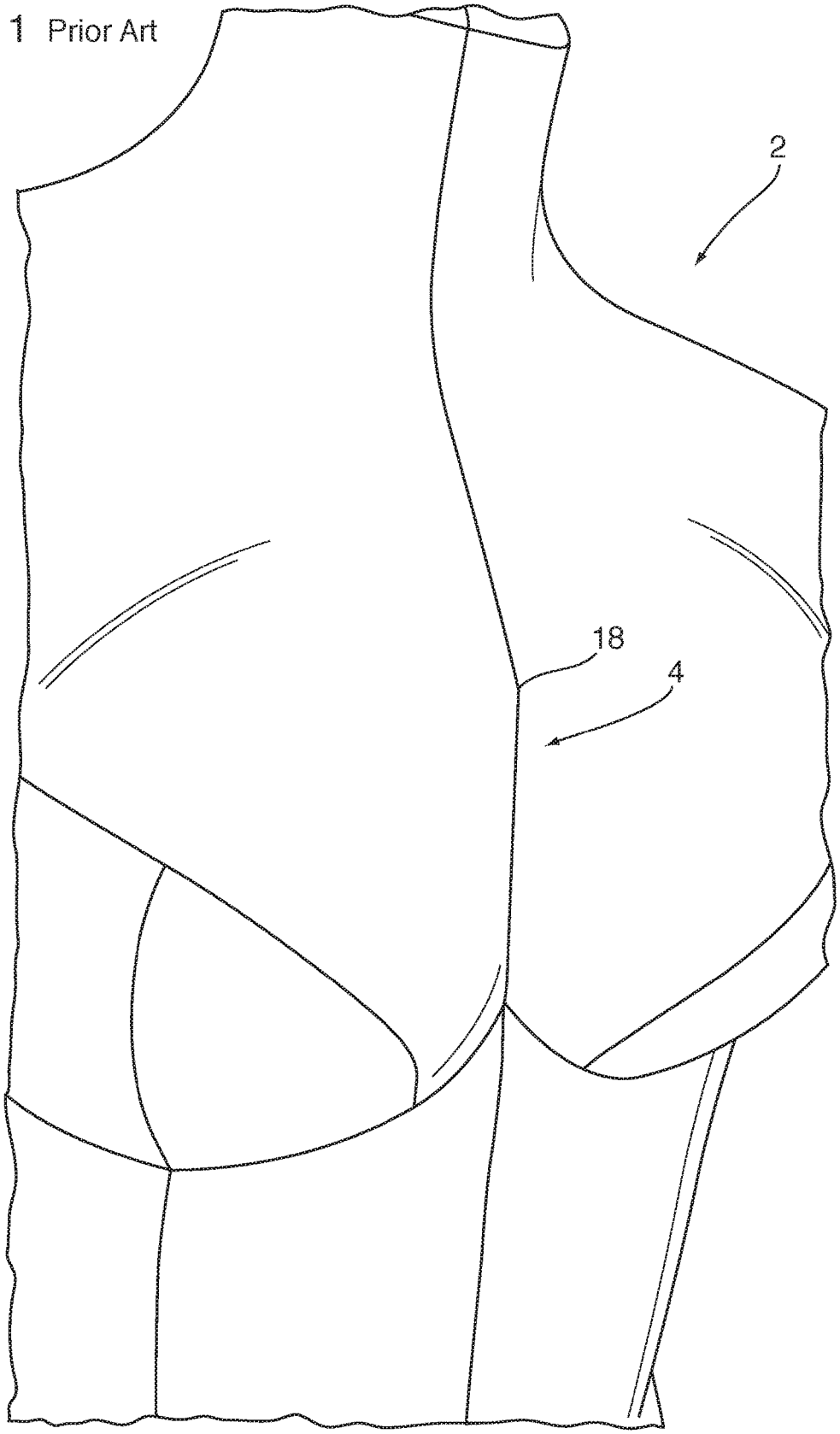
Fig. 1 Prior Art
FIG. 1 shows the central bust line of a portion of the upholstered mannequin of the Prior Art.
Figure 2:
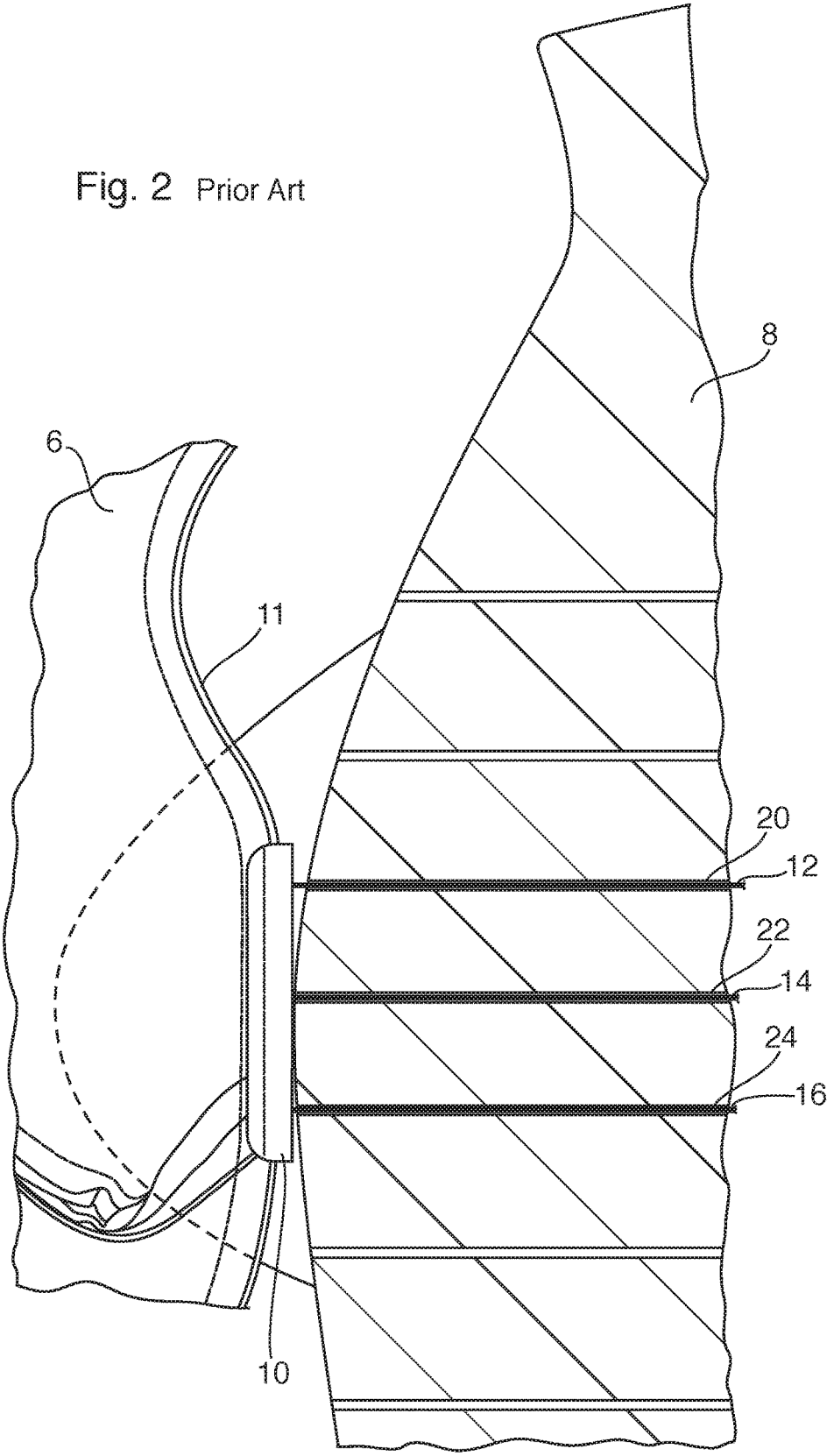
Fig. 2 Prior Art
FIG. 2 is a cross section of the mannequin along the central bust line showing the shaping body of the prior art attached and its attachment to the mannequin.
Figure 3:
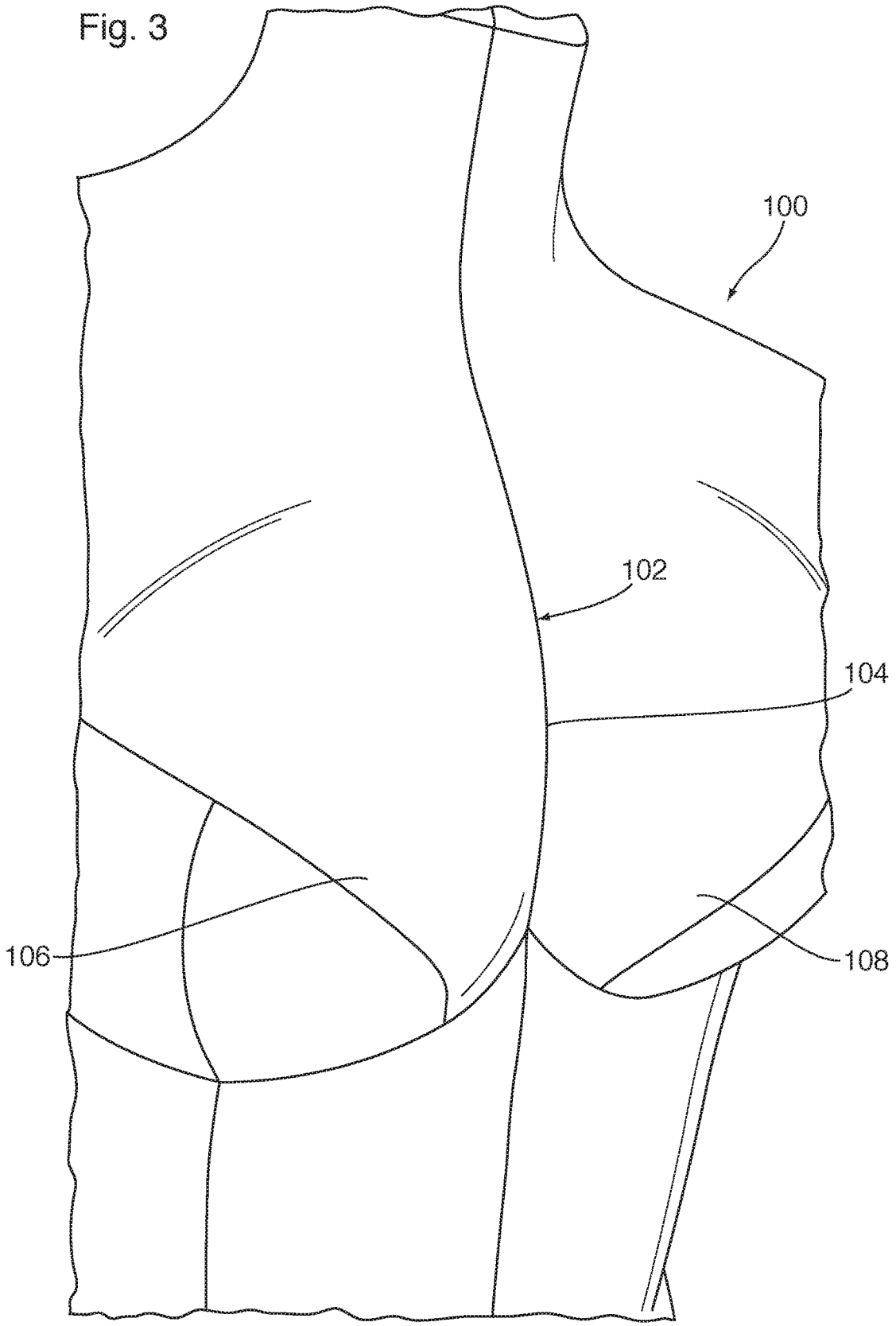
FIG. 3 shows the central bust line of a portion of the upholstered mannequin of the present invention
Figure 4:
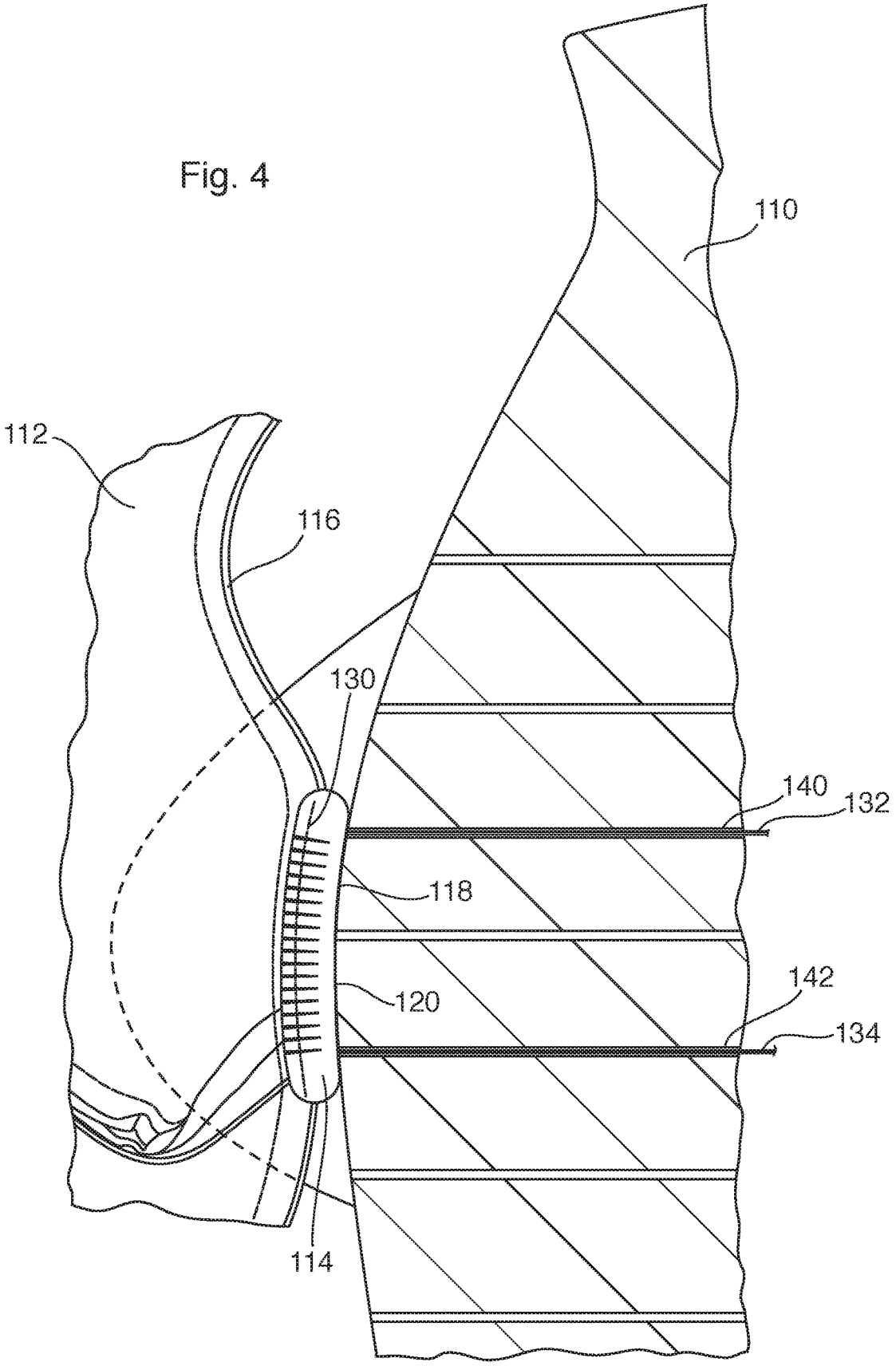
FIG. 4 is a cross section of the mannequin along the central bust line showing the shaping body of the preferred embodiment coupled to the upholstery fabric and showing the anchors passing through channels in the rigid mannequin.

FIG. 3 depicts the upholstered mannequin 100 of the preferred embodiment, having a central bust line 102 that has a smooth convex curve 104 between the breasts 106 and 108. As shown in FIG. 4, the mannequin consists of a rigid base form 110 with a soft upholstery cover 112. A shaping body 114 is coupled to the central bust line seam 116 of the upholstery 112. The shaping body 114 is generally elongate in shape and is curved such that the inner edge 118 lies flat along the convex curve 120 of the mannequin form 110 between the breasts. In its folded position, each end 160 and 162 of the shaping body 114 is curved to provide a smooth transition at the beginning and end of the shaping body. The shaping body 114 is coupled to the inner portion of the central bust line seam 116 in any acceptable manner, however, in the preferred embodiment the shaping body 114 is sewn to the inner seam 116 of the upholstery 112.

Figure 5:
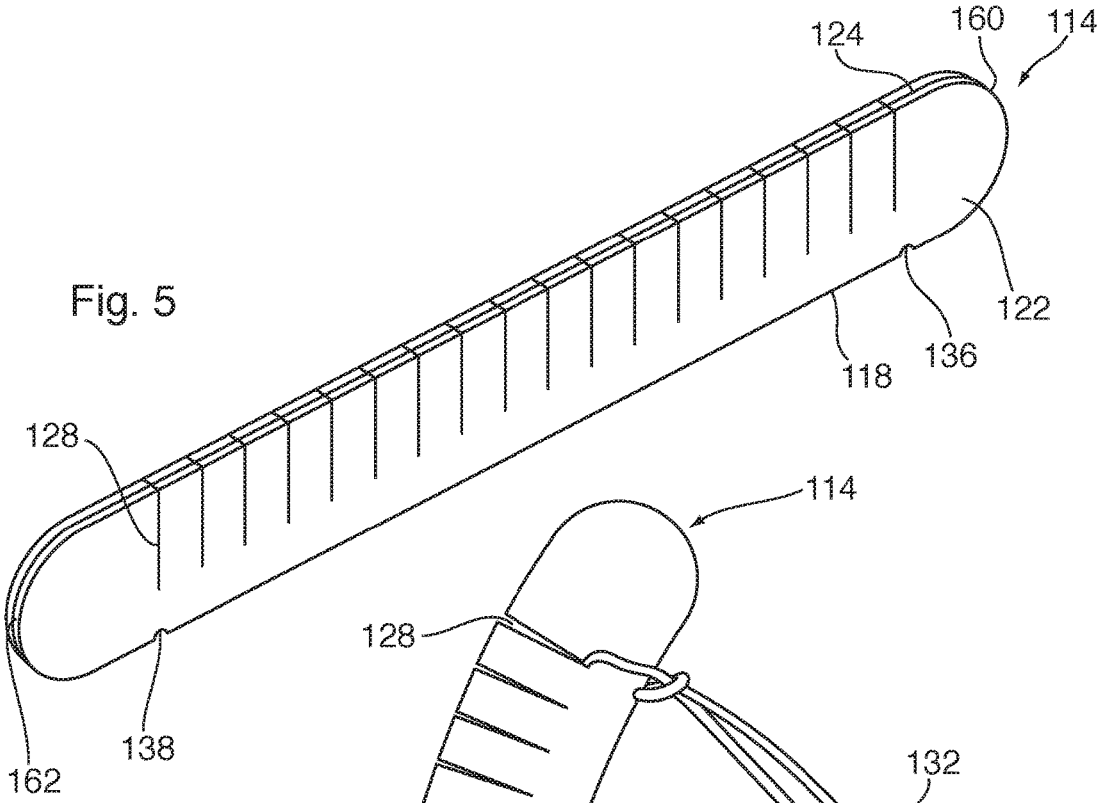
FIG. 5 shows the shaping body in its folded position before being curved.
Figure 6:
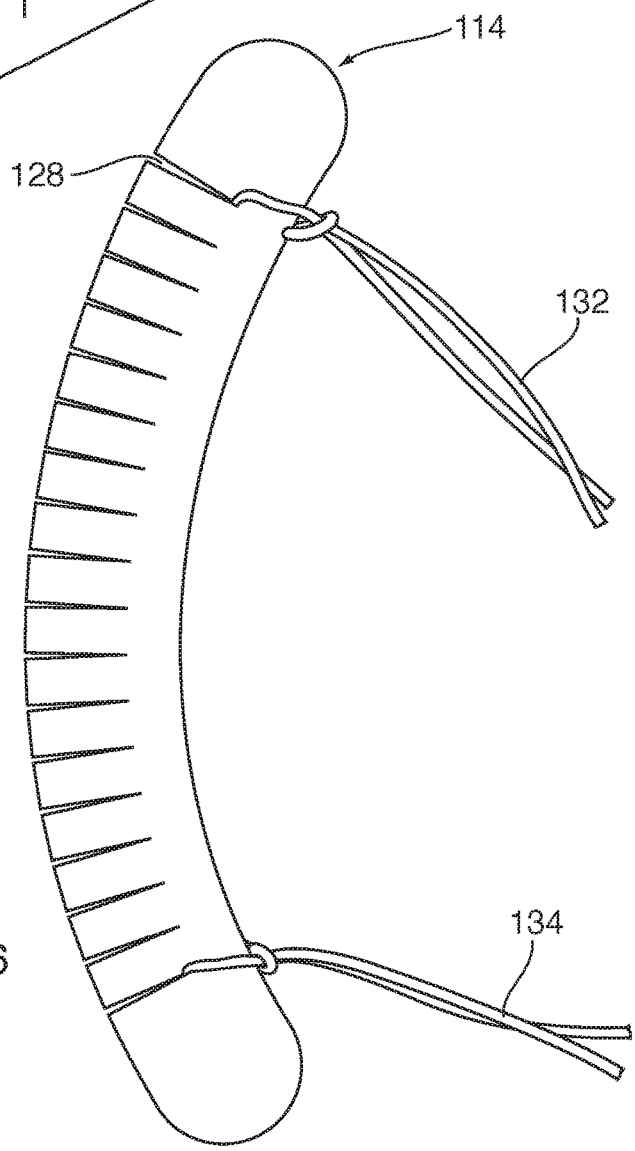
FIG. 6 shows the shaping body in its curved position with the anchors attached thereto.

The shaping body 114 is shown in isolation in FIGS. 5 and 6. FIG. 5 shows the shaping body 114 before it has been curved. It has a first side 122 and second side 124. Preferably these two sides are connected by a fold along the bottom edge 118, however, they could be two separate units.

In use, a first side 124 of the shaping body 114 is placed along one side of the central bust line seam 116 while the second side 122 is placed along the opposing side of central bust line seam 116. The shaping body is equipped with a plurality of slits shown as 128 which allows the shaping body to be formed into a curved shape. The slits allow flexibility for the shaping body 114 to be curved to match the convex curve of the central bust line of the hard form of the mannequin 110. Once in its curved position, the shaping body 114 is coupled to the bust line seam 116 by any suitable method. However in the preferred embodiment a seam shown as 130 in FIG. 4 is used to couple the shaping body 114 to the central bust line seam 116. This seam is preferably located over the portion of the shaping body with slits 128.

There are several ways in which the shaping body 114 can be coupled to the mannequin form 110, however in the preferred embodiment string anchors 132 and 134 are used. There are many ways in which the string anchors can be coupled to the shaping body that would be known to a person skilled in the art. However, in the preferred embodiment shown, the string anchors 132 and 134 are coupled to the shaping body 114 by creating a loop located in the middle of the string and feeding the loop through one of the holes, 136 and 138 respectively, from the inside of the folded shaping body to the outside of the shaping body. The ends of each string anchor are then fed through a slit 128 (for simplicity, only one of the slits is shown as an example of the many slits by reference character 128) and secured by being directed through the loop and pulled tight. Each anchor includes two string ends which need to be secured through the loop. In the preferred embodiment show in the figures, one string end is positioned through a slit in the first side 124 of the shaping body while the second end is positioned through a slit in the second side 122 of the shaping body. This helps keep the shaping body centered when coupling the shaping body and upholstery to the mannequin form 110.

Figure 7:
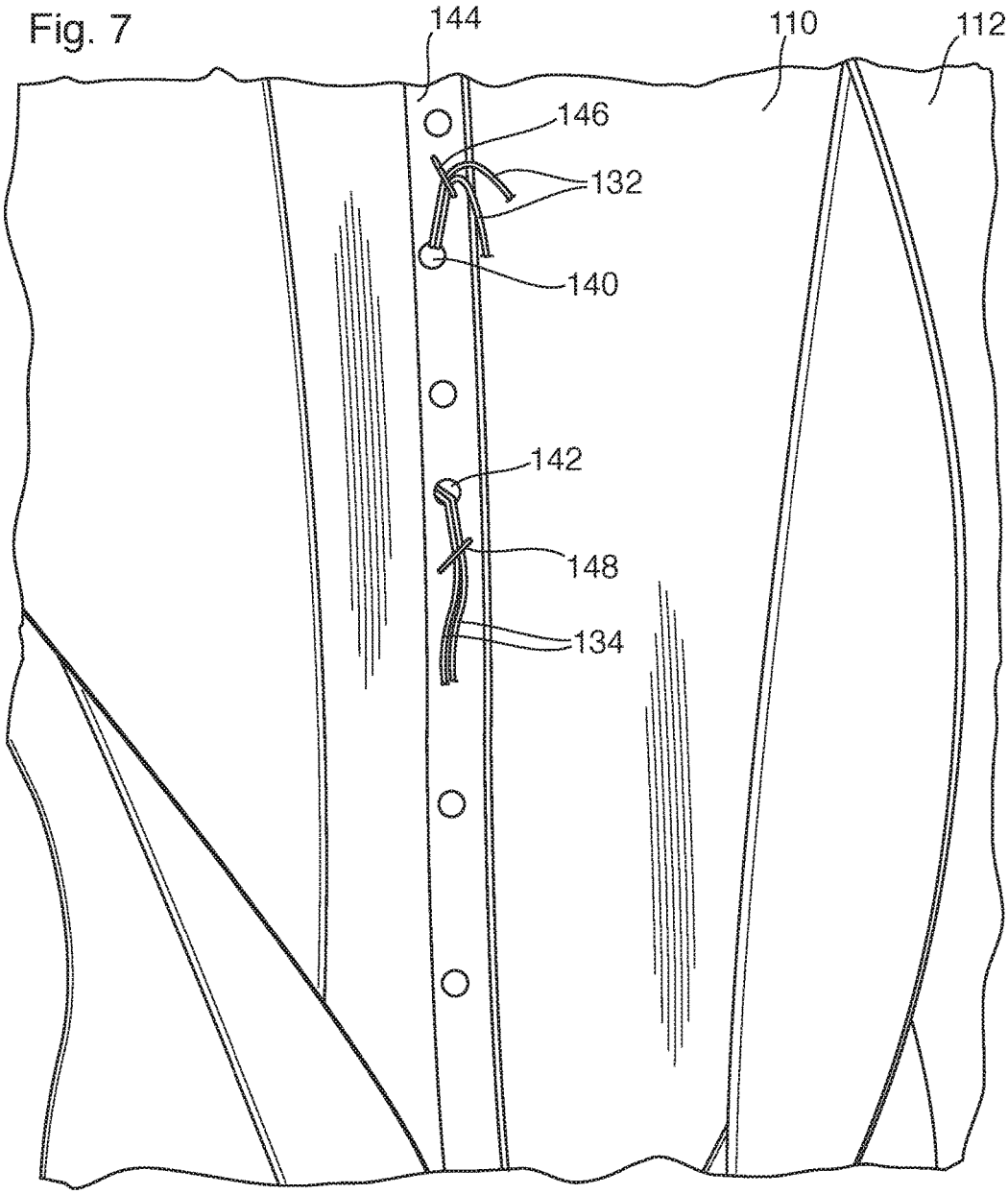
FIG. 7 shows a partial view of the back of the rigid mannequin where the anchors are attached thereto.

Once coupled to the shaping body, these string anchors 132 and 134 are then fed through channels 140 and 142 in the mannequin form 110. In a preferred embodiment, the channels are made by drilling holes through the mannequin. The anchors are tensioned such that the bottom edge 118 of the shaping body 114 lays flat against the bust line of the mannequin form 110. The anchors are then secured to the back of the mannequin form using staples 146 and 148 as shown in FIG. 7, In a preferred embodiment the back of the mannequin form 110 includes a recessed channel 144 in which the staples 146 and 148 are attached. Any tails of the anchors 132 and 134 also lay flat within the channel 144. This ensures that when the upholstery 112 is closed at the back, there are no lumps caused by the anchors 132 and 134 or the staples 146 and 148.

Figure 10:
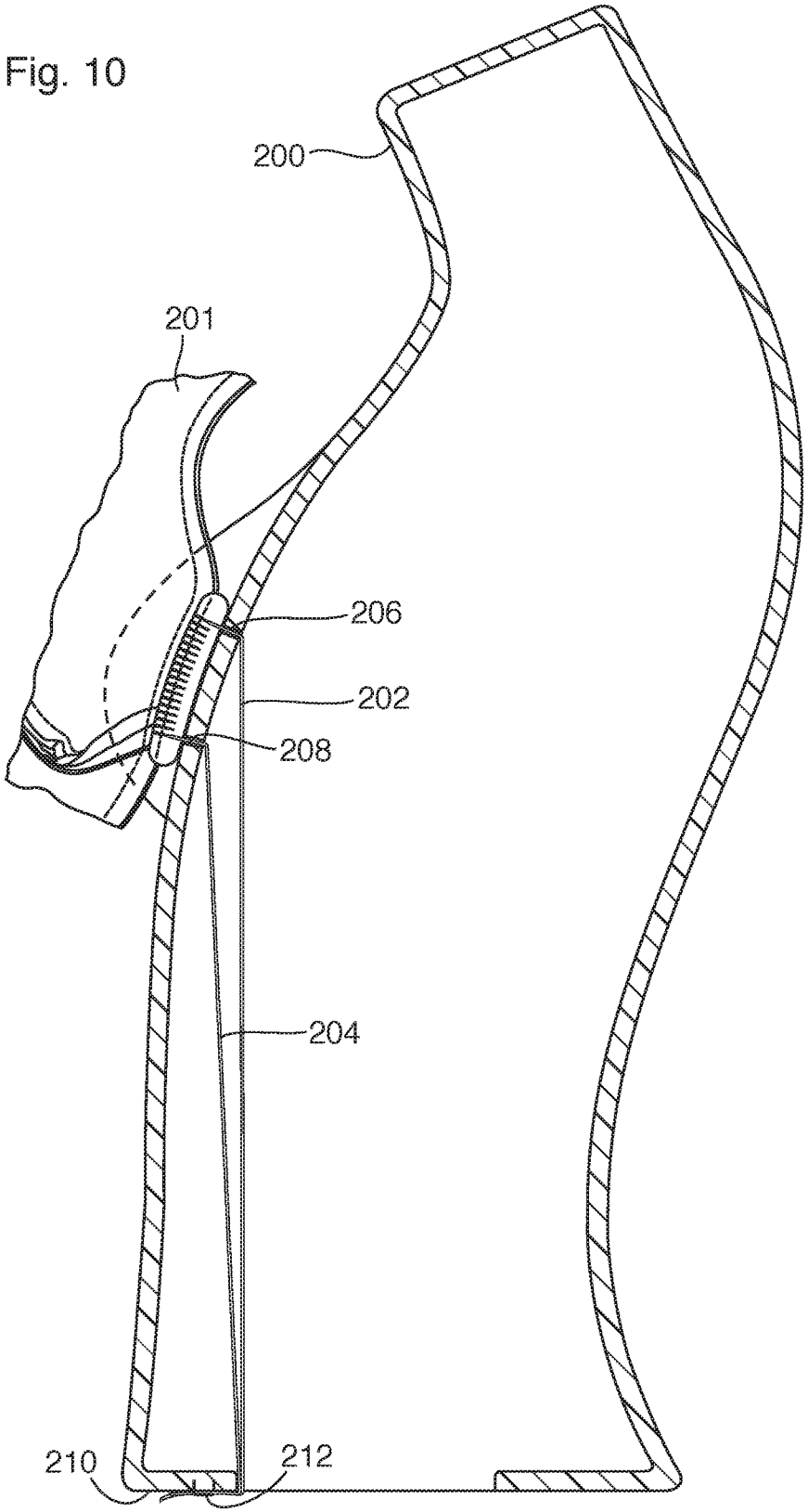
FIG. 10 is a cross section of the mannequin form along the central bust line wherein the shaping body and upholstery applied thereto with a front anchoring arrangement.

FIG. 10 shows an alternative embodiment wherein the upholstery 201 is to be applied to a hollow mannequin form 200. In this embodiment, the anchor strings 202 and 204 pass through channels 206 and 208 respectively in the hollow mannequin form 200. They are then directed downwardly and coupled to the bottom 210 of the mannequin form. The anchors can be coupled in any suitable manner, however in the preferred embodiment shown, they are coupled to the mannequin form 200 by means of staples 212. As can be appreciated, the anchors could also be coupled to anywhere on the inside of the mannequin.

Once the shaping body 114 has been secured into place, the upholstery 112 can be wrapped around the hard form of the mannequin. In doing so, the first side 124 and second side 122 of the shaping body 114 are spread apart and lie flat against opposing sides of the central bust line of the hard form of the mannequin 110. The mannequin can then be upholstered as known to a person skilled in the art.

Figure 8:
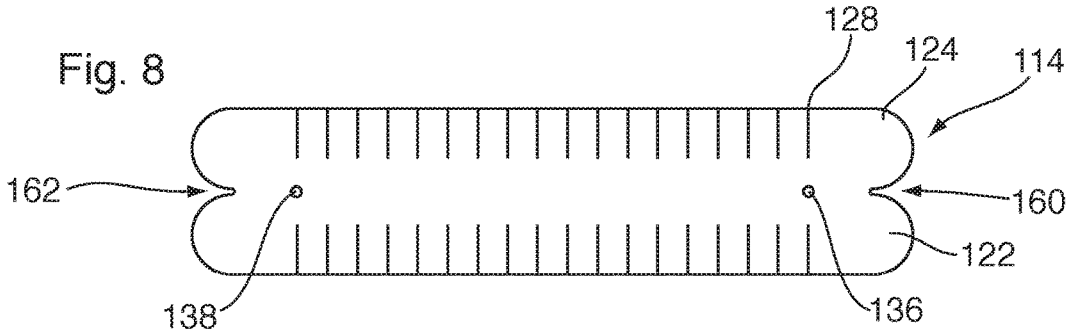
FIG. 8 shows the shaping body blank.
Figure 9:
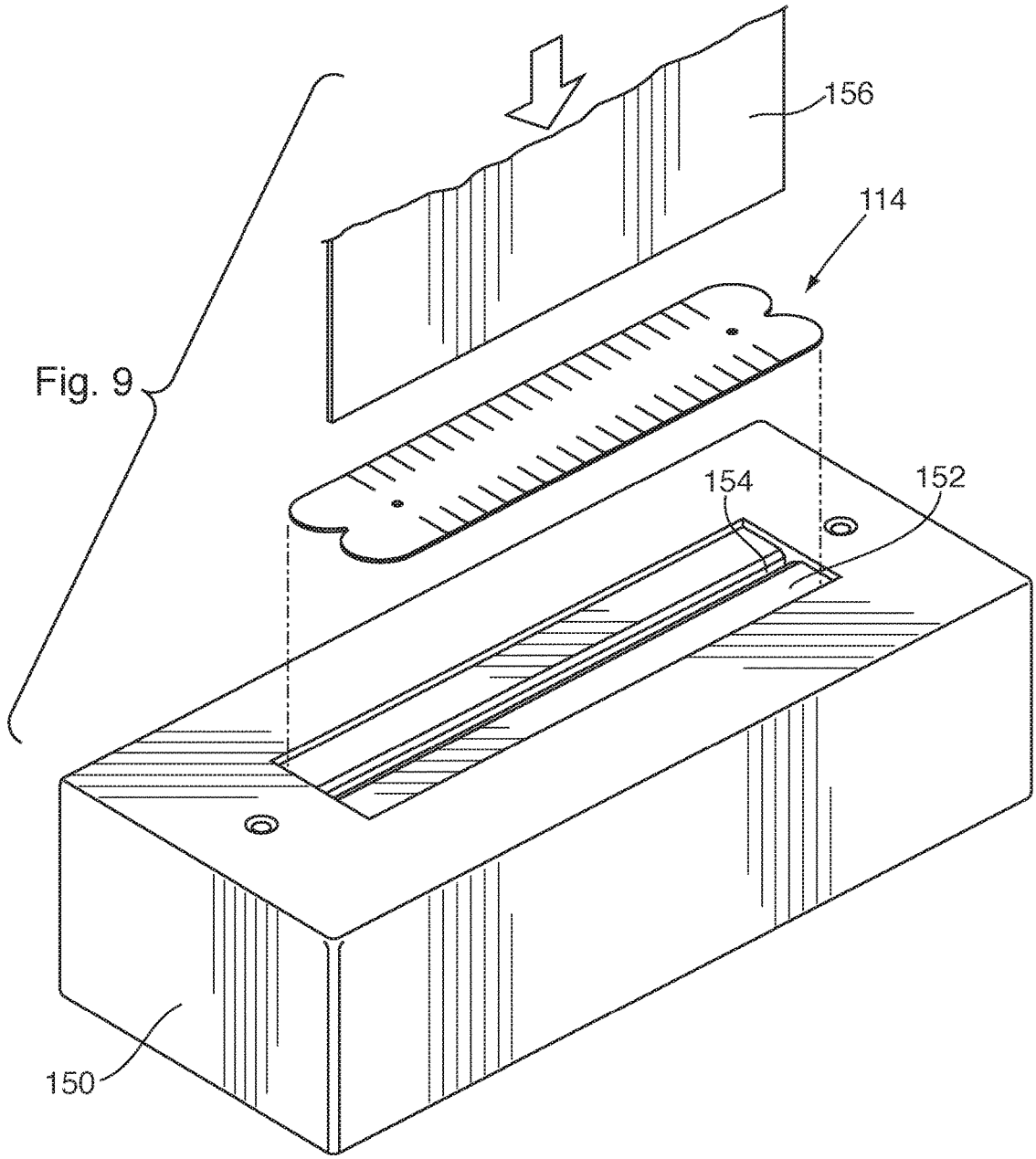
FIG. 9 shows the shaping body blank and die for folding the shaping body.

The shaping body 114 is preferably dye cut from belting material or any other material with suitable or similar stiffness. The shape of the blank form for the dye cut is shown in FIG. 8. The shaping body 114 is preferably dye cut with the slits 128 however both slits 128 and holes 136 and 138 could be formed in a secondary process. As shown in FIG. 9, the blank of the shaping body 114 is then placed in a dye 150 in order to be folded. The dye 150 contains a recess 152 sized to accommodate the blank of the shaping body 114. The recess 152 contains a further centrally located channel 154. A blade 156 is pressed down along the centre line of the blank of the shaping body 114 to fold the shaping body in half. The resulting shape is shown in FIG. 5. This is one example of a preferred embodiment of how the shaping body 114 could be manufactured. Other methods are known to a person skilled in the art.

It should be noted that although the shaping body of the preferred embodiment includes slits 128 to allow the shaping body to curve to fit the shape of the mannequin 110 at the bust line, other techniques could be used to create a curved shaping body. For example the blank could be designed such that when folded in half the shaping body is already curved to match the bust line curve of the mannequin 110.

Although various preferred embodiments of the present invention have been described herein in detail, it will be appreciated by those skilled in the art that variations may be made thereto without departing from the appended claims.

The embodiments of the invention in which an exclusive property or privilege is claimed are defined as follows:

1. A shaping device for creating a central bust line on a mannequin having substantially rigid base form and an upholstery cover comprising;

an elongate shaping body configured to be coupled to the upholstery covering along the central bust line;

at least one anchor for coupling the shaping body to the base form; and wherein the shaping body is designed such that when coupled to the base form one edge of said shaping body conforms to the shape of the central bust line of the base form.

2. A shaping device as claimed in claim 1 wherein said shaping body is curved to conform with the curve of the central bust line of the base form.

3. A shaping device as claimed in claim 2 wherein said shaping body has a first body member and a second body member joined by a fold therebetween and wherein said first body member is coupled to a first side of a central bust line seam of the upholstery covering and said second body member is coupled to a second side of said central bust line seam of the upholstery covering; and Wherein said fold conforms to the shape of the central bust line of said base form.

4. A shaping device as claimed in claim 3 wherein the curve of the central bust line of the base form is convex.

5. A shaping device as claimed in claim 4 wherein first body member and said second body member of said shaping body include a series of slits opposite said fold to allow said shaping device to curve to generally conform to the shape of the central bust line of the base form.

6. A shaping device as claimed in claim 5 wherein said at least one anchor is a string coupled to said shaping device and fed through a hole in said base form and is fixed to said base form.

7. A shaping device as claimed in claim 6 wherein said shaping device includes two anchors.

8. A shaping device as claimed in claim 7 wherein said two anchors are positioned at opposite ends along the length of the shaping body.

* * * * *